US006577076B2

(12) United States Patent
Li et al.

(10) Patent No.: US 6,577,076 B2
(45) Date of Patent: Jun. 10, 2003

(54) ADAPTIVE CONTROL FOR HALF-BRIDGE UNIVERSAL LAMP DRIVERS

(75) Inventors: Qiong M. Li, Cortlandt Manor, NY (US); Demetri Giannopoulos, Norwalk, CT (US); Ihor T. Wacyk, Briarcliff Manor, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/946,062

(22) Filed: Sep. 4, 2001

(65) Prior Publication Data

US 2003/0057881 A1 Mar. 27, 2003

(51) Int. Cl.[7] ..... G05F 1/00

(52) U.S. Cl. ..... 315/291; 315/307; 315/224; 315/209 R; 315/126; 315/360; 315/DIG. 4

(58) Field of Search ..... 315/291, 224, 315/307, 209 R, 360, 362, 119, 126, 127, DIG. 4, DIG. 7, 308, 244

(56) References Cited

U.S. PATENT DOCUMENTS 4,791,338 A * 12/1988 Dean et al. ..... 315/102
5,677,602 A * 10/1997 Paul et al. ..... 315/224
5,910,712 A * 6/1999 Toyama ..... 315/224
5,925,990 A * 7/1999 Crouse et al. ..... 315/127
6,160,361 A 12/2000 Giannopoulos et al. ..... 315/307
6,188,183 B1 * 2/2001 Greenwood et al. ..... 315/224
6,351,081 B1 * 2/2002 Hwang ..... 315/119

FOREIGN PATENT DOCUMENTS

EP 0702508 A1 3/1996
EP 1041862 A1 10/2000
WO WO0072640 11/2000

* cited by examiner

*Primary Examiner*—Haissa Philogene

(57) ABSTRACT

An adaptive compensation circuit for controlling a universal lamp driver coupled to a lamp is disclosed. The adaptive compensation circuit utilizes an identification of a lamp type of the lamp to thereby generate a signal indicative of a time constant of the lamp. The adaptive compensation circuit subsequently determines a zero position and a pair of pole positions corresponding to the time constant, and generates a control voltage in response to a determination of the zero position and the pair of pole positions. The control voltage facilitates an operation of the universal lamp driver to stably provide a lamp current to the lamp.

13 Claims, 7 Drawing Sheets

ADAPTIVE CONTROL FOR HALF-BRIDGE UNIVERSAL LAMP DRIVERS

BACKGROUND OF THE INVENTION

1. Field of the Invention

The present invention generally relates to controlling a dimming of various types of lamps. The present invention specifically relates to hindering discontinuities and oscillations within a lamp due to the ionization and recombination time delay of the lamp during steady state operation.

2. Description of the Related Art

FIGS. 1 and 4 illustrates a known structural arrangement of a universal lamp driver 20 including a N-depletion metal oxide semiconductor field-effect transistor ("MOSFET 1"), a N-depletion metal oxide semiconductor field-effect transistor ("MOSFET 2"), a capacitor $C_1$, an inductor $L_1$, and a capacitor $C_2$ for providing a lamp voltage $V_L$ and a lamp current $I_L$ to lamp 10 in response to a source supply voltage $V_{SS}$ and a source supply current $I_{SS}$. FIG. 1 further illustrates a conventional multiplier 30 and a known structural arrangement of a feedback compensation circuit 40 having a conventional gate driver 41, a conventional pulse width modulator 42, a comparator in the form of an operational amplifier ("OP AMP 1"), a capacitor $C_3$, and a resistor $R_2$. Multiplier 30 computes and provides a lamp power signal $LP_S$ to feedback compensation circuit 40 that is indicative of lamp voltage $V_L$ and lamp current $I_L$. In response to lamp power signal $LP_s$ and a reference voltage $V_{REF}$, feedback compensation circuit 40 controls an active mode of operation of MOSFET 1 and an active mode of operation of MOSFET 2 whereby lamp current $I_L$ can be adjusted to thereby adjust a dimming level of lamp 10.

An advantage of universal lamp driver 20 is the ability to drive various forms of lamp 10 (e.g., any type of gas discharge lamp). A disadvantage of feedback compensation circuit 40 is the inability to control an adjustment of lamp current $I_L$ for all types of various forms of lamp 10. FIG. 2 illustrates the inability of feedback compensation circuit 40 to control an adjustment of lamp current $I_L$ within an inaccessible area. The result is a discontinuity in lamp current $I_L$ as illustrated in FIG. 3A.

FIG. 4 illustrates a rectifier 50 and a known structural arrangement of a feedback compensation circuit 60 having a conventional gate driver 61, a conventional voltage controlled oscillator 62, a comparator in the form of an operational amplifier ("OP AMP 2"), a capacitor $C_4$, a capacitor $C_5$, a resistor $R_3$, and a resistor $R_4$. Rectifier 50 computes and provides lamp power signal $LC_S$ to feedback compensation circuit 60 that is indicative of lamp current $I_L$. In response to lamp current signal $LC_S$ and reference voltage $V_{REF}$, feedback compensation circuit 60 controls an active mode of operation of MOSFET 1 and an active mode of operation of MOSFET 2 whereby lamp current $I_L$ can be adjusted while experiencing a continuity as illustrated in FIG. 3B.

However, a disadvantage of feedback compensation circuit 60 is the inability to provide a compensation to half-bridge universal lamp driver 20 that is adapted to a particular type of lamp 10. The result is an instability problem of lamp driver 20 for some types of lamp 10. For example, feedback compensation circuit 60 can be designed to provide a 2 pole-1 zero compensation with a zero at 200 rad/sec and a pole at 10 rad/sec. Consequently, lamp current $I_L$ can be unstable as illustrated in FIG. 5A when lamp 10 is a type of lamp having a time constant of 50 $\mu$s during steady state operation, and lamp current $I_L$ can be stable as illustrated in FIG. 5B when lamp 10 is a type of lamp having a time constant of 500 $\mu$s during steady state operation.

The present invention addresses the shortcomings of the prior art.

SUMMARY OF THE INVENTION

The present invention relates to an adaptive control of universal lamp drivers. Various aspects of the present invention are novel, non-obvious, and provide various advantages. While the actual nature of the present invention covered herein can only be determined with reference to the claims appended hereto, certain features, which are characteristic of the embodiments disclosed herein, are described briefly as follows.

One form of the present invention is a method of adaptively controlling a lamp driver coupled to a lamp. First, a time constant corresponding to the lamp is determined. Second, the lamp driver is operated to provide a lamp current to the lamp as a function of the time constant of the lamp.

A second form of the present invention is a device comprising a lamp driver and an adaptive compensation circuit. The lamp driver is operable to provide a lamp current to a lamp. The adaptive compensation circuit is operable to control the lamp current as a function of a time constant of the lamp.

The foregoing forms and other forms, features and advantages of the present invention will become further apparent from the following detailed description of the presently preferred embodiments, read in conjunction with the accompanying drawings. The detailed description and drawings are merely illustrative of the present invention rather than limiting, the scope of the present invention being defined by the appended claims and equivalents thereof.

DETAILED DESCRIPTION OF THE PRESENTLY PREFERRED EMBODIMENTS

Figure 1:
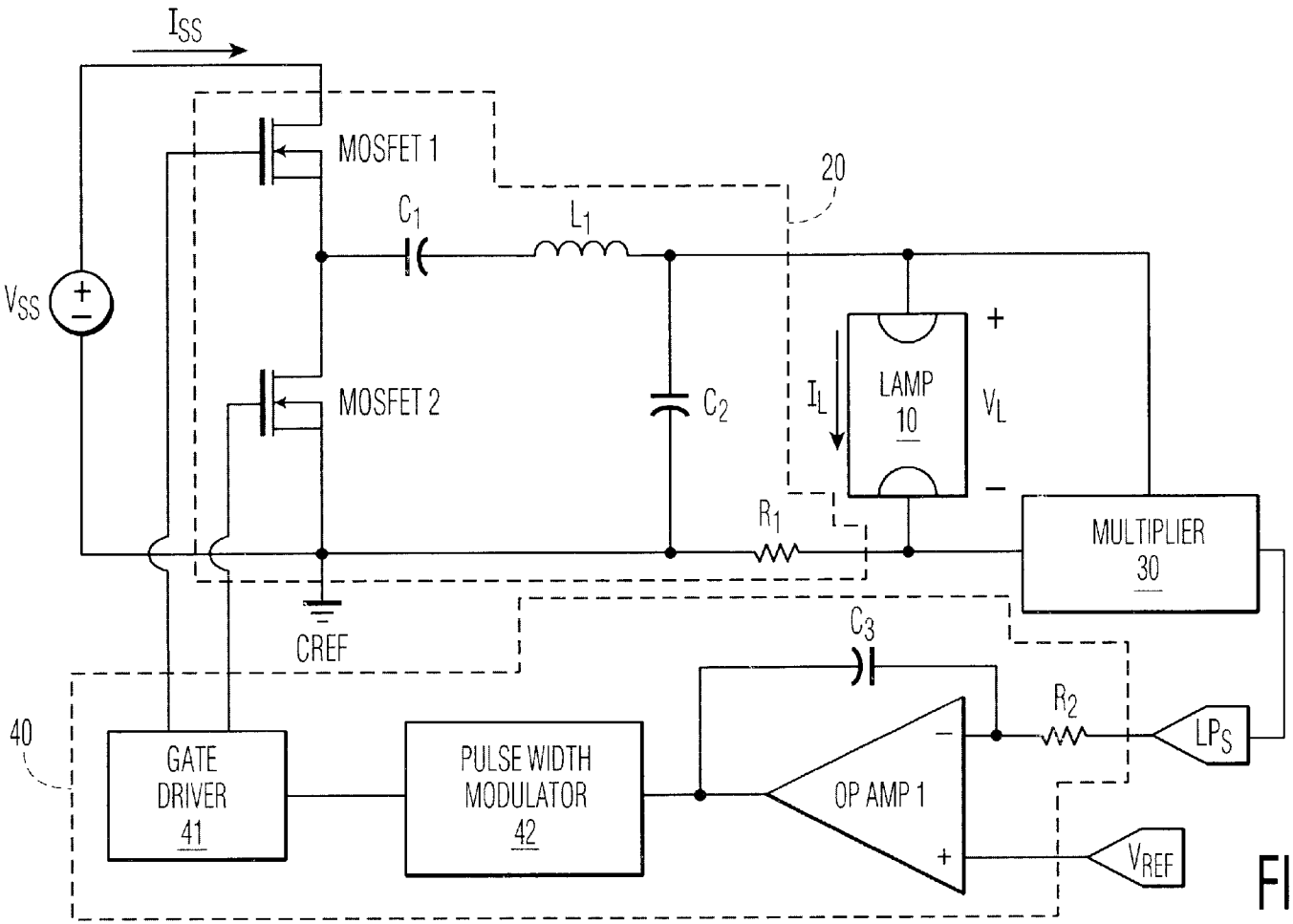
FIG. 1 PRIOR ART
FIG. 1 illustrates a universal lamp driver and a power feedback compensation circuit as known in the art.
Figure 2:
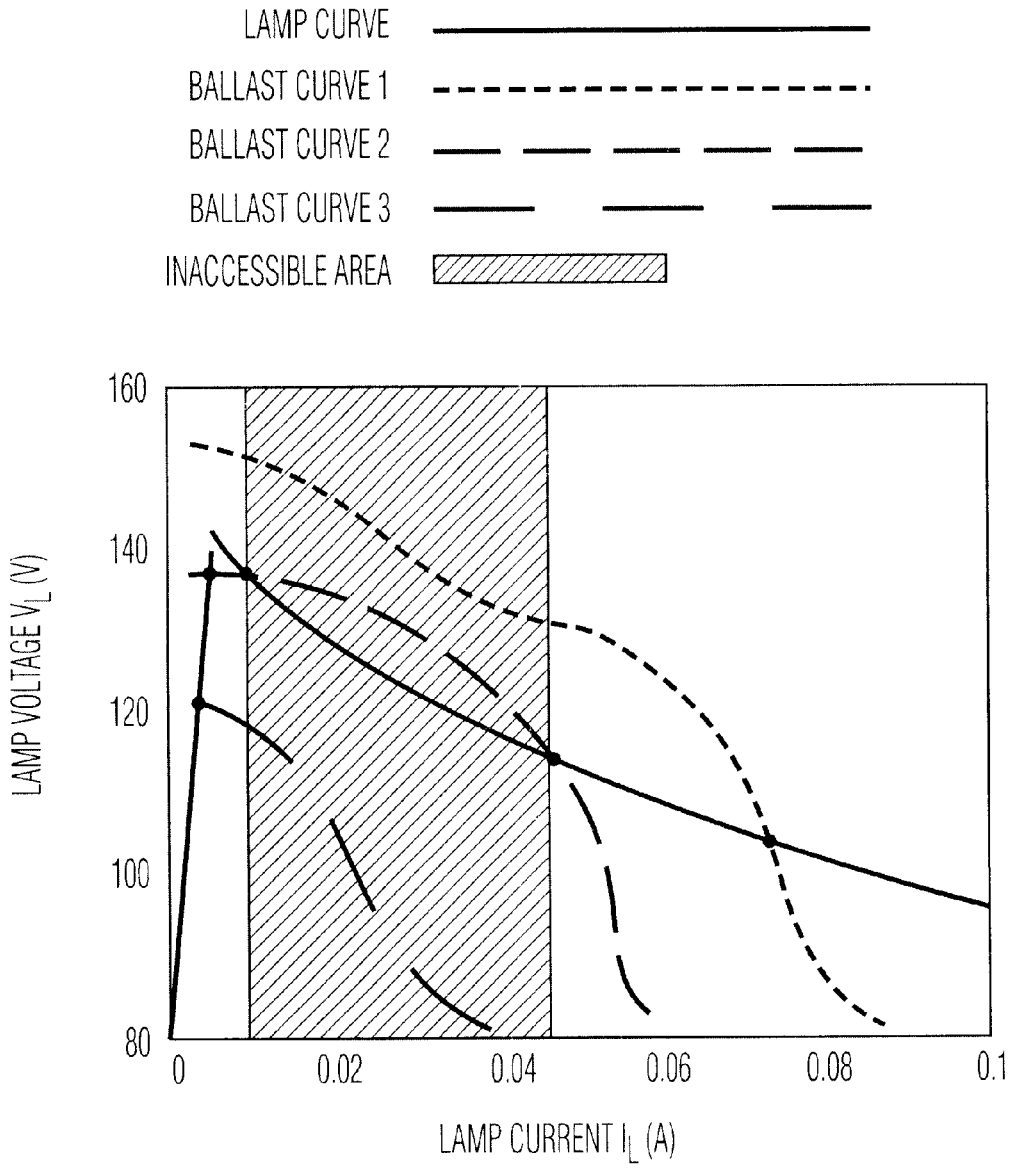
FIG. 2 illustrates a graph of a lamp current vs a lamp voltage generated and controlled by the universal lamp driver and the power feedback compensation circuit of FIG. 1.
Figure 6:
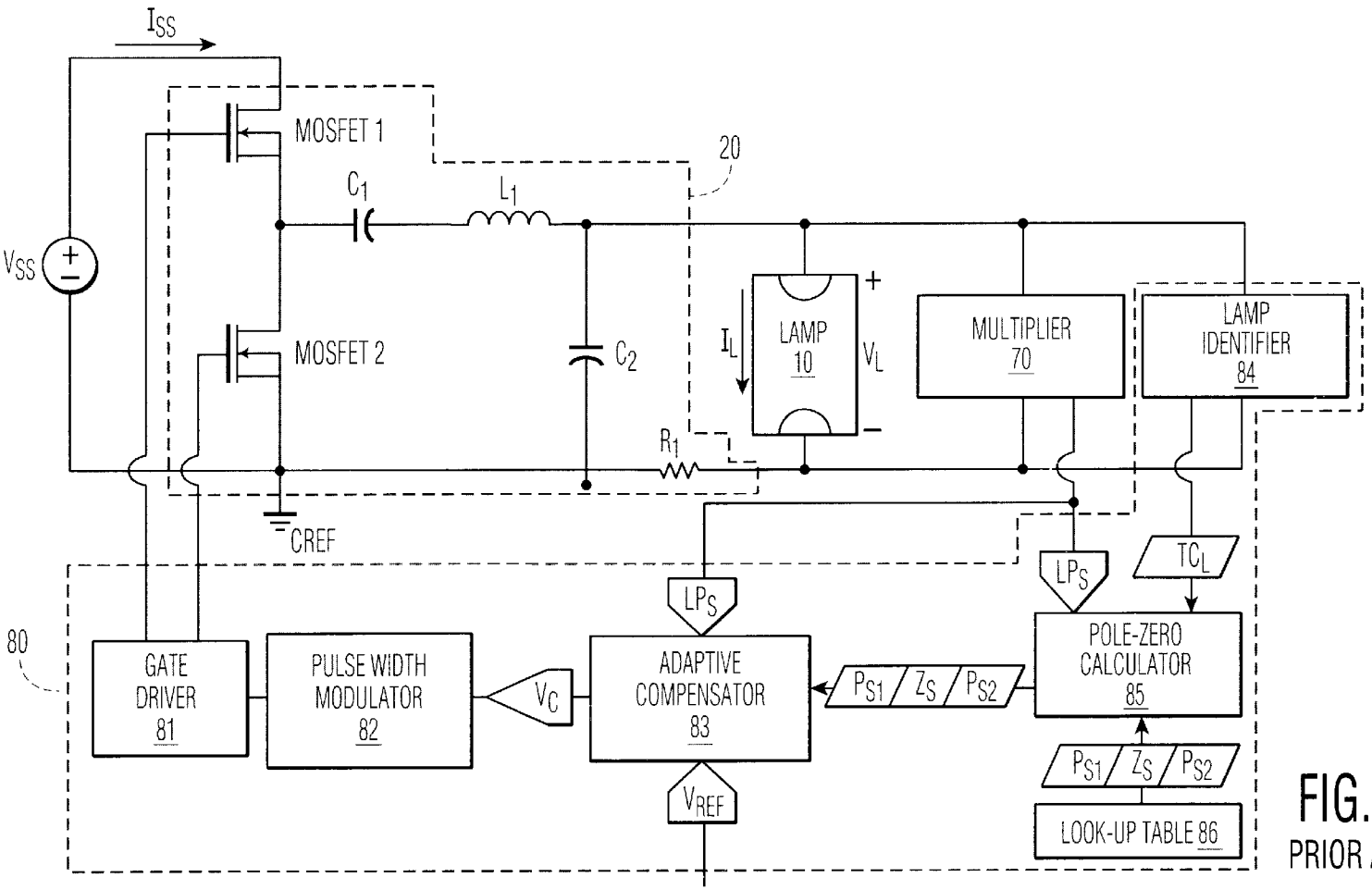
FIG. 6 PRIOR ART
FIG. 6 illustrates a first embodiment of a universal lamp driver and an adaptive feedback compensation circuit in accordance with the present invention.

FIG. 6 illustrates universal lamp driver 20 as previously described herein in connection with FIG. 1 as well as a conventional multiplier 70 and an adaptive compensation circuit 80 in accordance with the present invention. Adaptive compensation circuit 80 comprises a conventional gate driver 81 and a conventional pulse width modulator 82. Adaptive compensation circuit 80 further comprises a lamp identifier 84, a pole-zero calculator 85, a look-up table 86, and an adaptive compensator 83, all of which can consist of digital circuitry, analog circuitry, or both.

Lamp identifier 84 is operable to provide a time constant signal $TC_S$ that is indicative of a time constant of lamp 10 to pole-zero calculator 85 in response to lamp voltage $V_L$. In one embodiment, lamp identifier 84 generates time constant signal $TC_S$ by identifying the type of lamp 10 as disclosed in a U.S. Pat. No. 6,160,361, entitled "For Improvements In A Lamp Type Recognition Scheme" and issued on Dec. 12, 2000, which the entirety of is hereby incorporated by reference and is owned by the assignee of this patent.

In response to time constant signal $TC_S$ and lamp power signal $LP_S$, pole-zero calculator 85 is operable to retrieve a first pole position signal $P_{S1}$, a zero position signal $Z_S$, and a second pole position signal $P_{S2}$ from look-up table 86, all of which correspond to the time constant of lamp 10. Pole position signal $P_{S1}$ is indicative of a low frequency (e.g., 10–20 rad/sec). Pole position signal $P_{S2}$ is indicative of a high frequency (e.g., 1,000–50,000 rad/sec). Zero position signal $Z_S$ is indicative of a frequency between the low frequency indicated by pole position signal $P_{S1}$ and the high frequency indicated by pole position signal $P_{S2}$. The following TABLE 1 is an exemplary embodiment of look-up table 86:

TABLE 1

| TIME CONSTANT (μs) | LOW POLE POSITION (rad/sec) | ZERO POSITION (rad/sec) | HIGH POLE POSITION (rad/sec) |
|---|---|---|---|
| 50 | 10 | 600 | 10,000 |
| 500 | 10 | 200 | 1,000 |
| 200 | 10 | 430 | 4,600 |

Figure 3A:
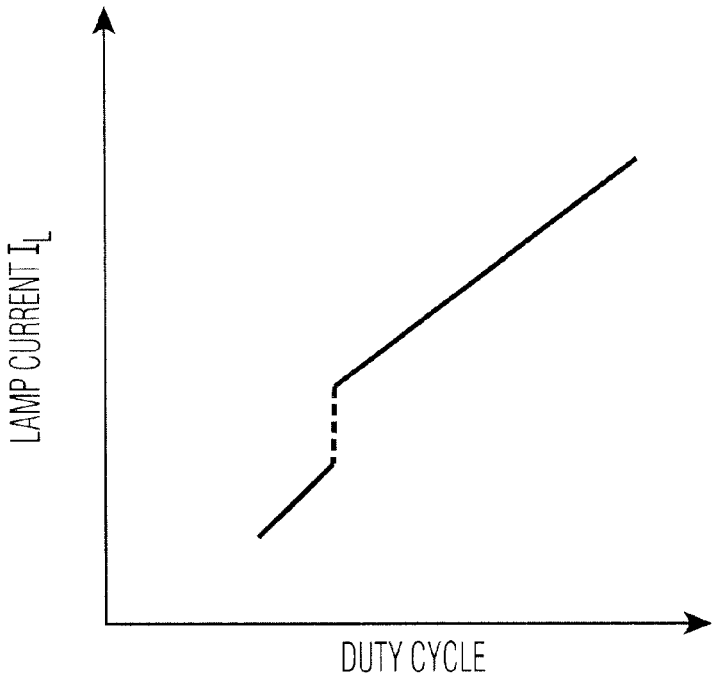
FIG. 3A illustrates a graph of a lamp current experiencing a discontinuity.
Figure 3B:
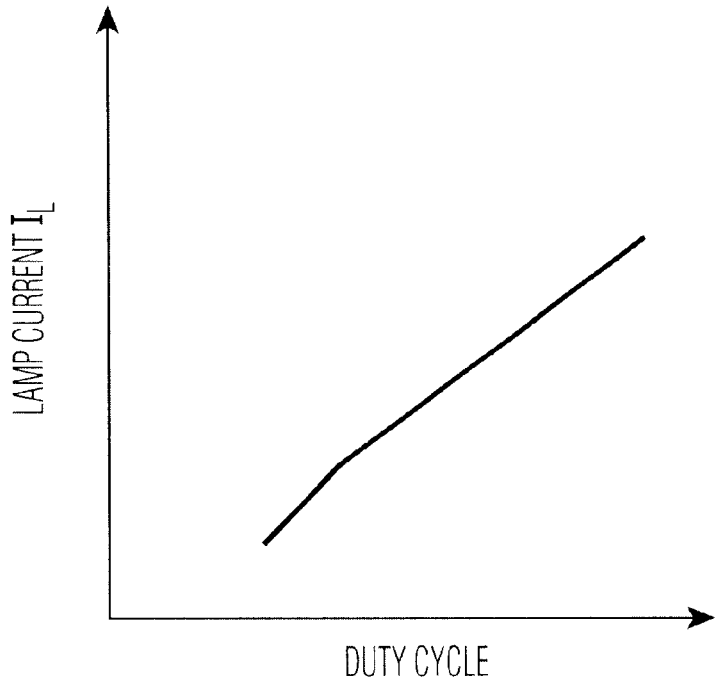
FIG. 3B illustrates a graph of a lamp current experiencing a continuity.
Figure 4:
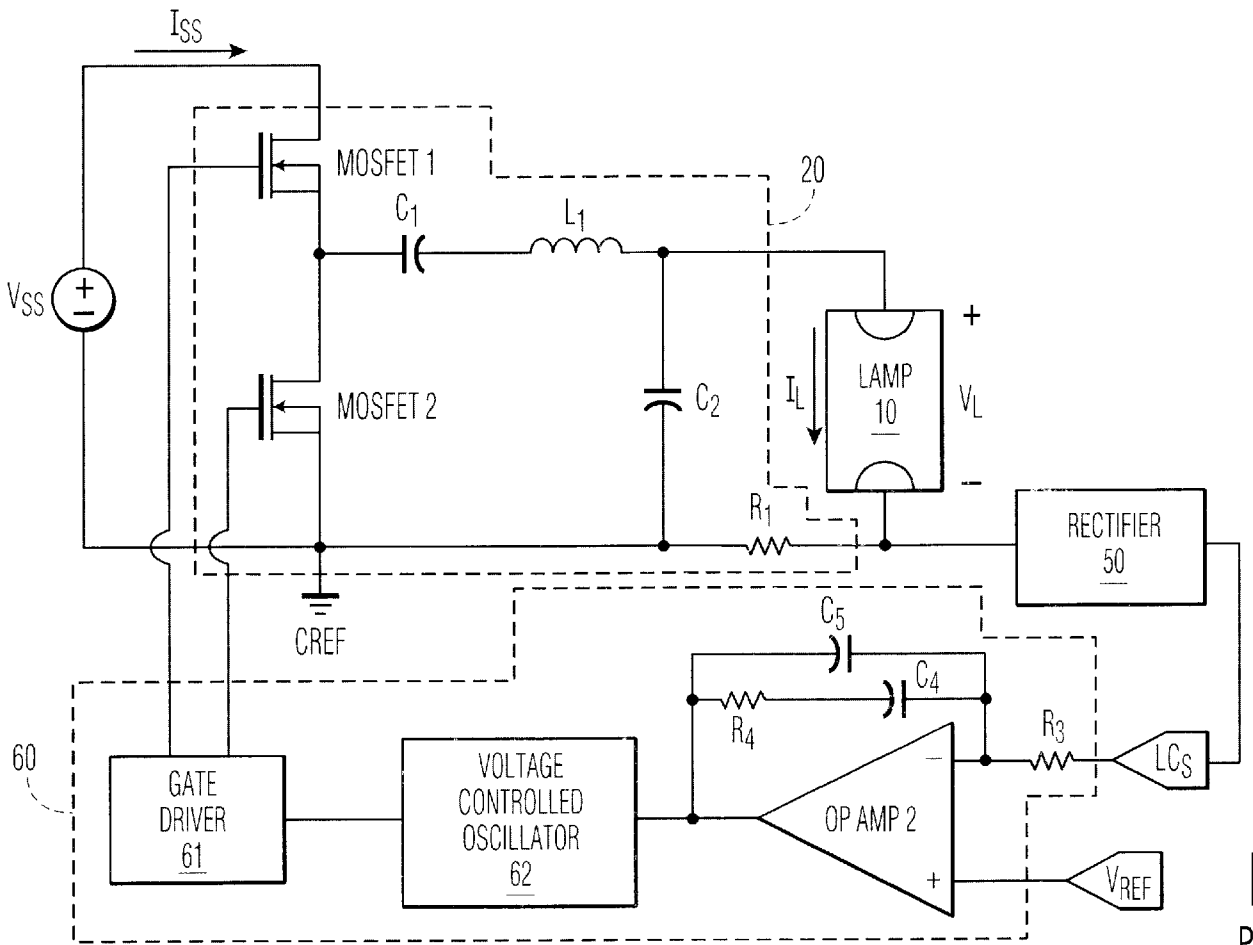
FIG. 4 PRIOR ART
FIG. 4 illustrates a universal lamp driver and a current feedback compensation circuit as known in the art.
Figure 5A:
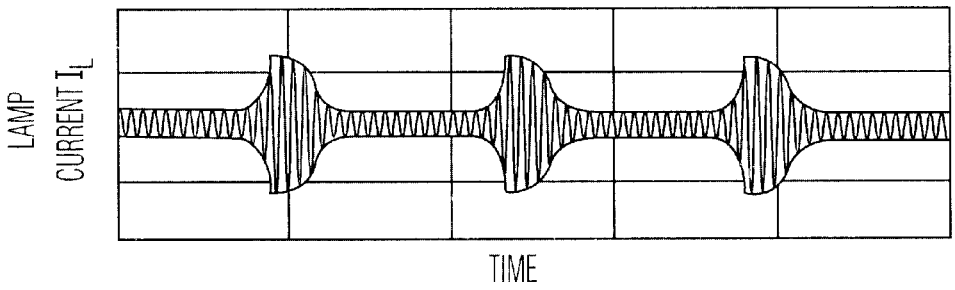
FIG. 5A illustrates a first graph of an unstable lamp current.
Figure 5B:
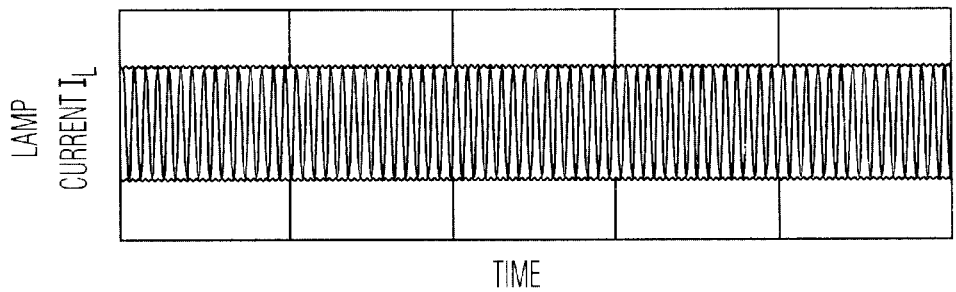
FIG. 5B illustrates a second graph of stable lamp current.

Pole-zero calculator 85 provides pole position signal $P_{S1}$, zero position signal $Z_S$, and a second pole position signal $P_{S2}$ to adaptive compensator 83. In response thereto as well as lamp power signal $LP_S$ and a voltage reference $V_{REF2}$, adaptive compensator 83 computes a control voltage $V_C$ for conventionally operating pulse width modulator 82 and gate driver 81 whereby lamp current $I_L$ is continually and stably controlled as shown in FIGS. 3B and 5B. In one embodiment, adaptive compensator 83 computes control voltage $V_C$ in accordance with the following Laplace transfer function [1] in a frequency domain:

$$K^*[(S+Z_S)/\{(S+P_{S1})^*(S+P_{S2})\}] \quad [1]$$

where K is the dc gain of the compensation which is adjusted by the feedback loop established by compensation circuit 80. Those having ordinary skill in the art will appreciate the circuitry illustrated in FIG. 6 is an open loop circuit prior to an identification of the type of lamp 10 and a closed load circuit upon an initial computation of control voltage $V_C$.

Figure 7:
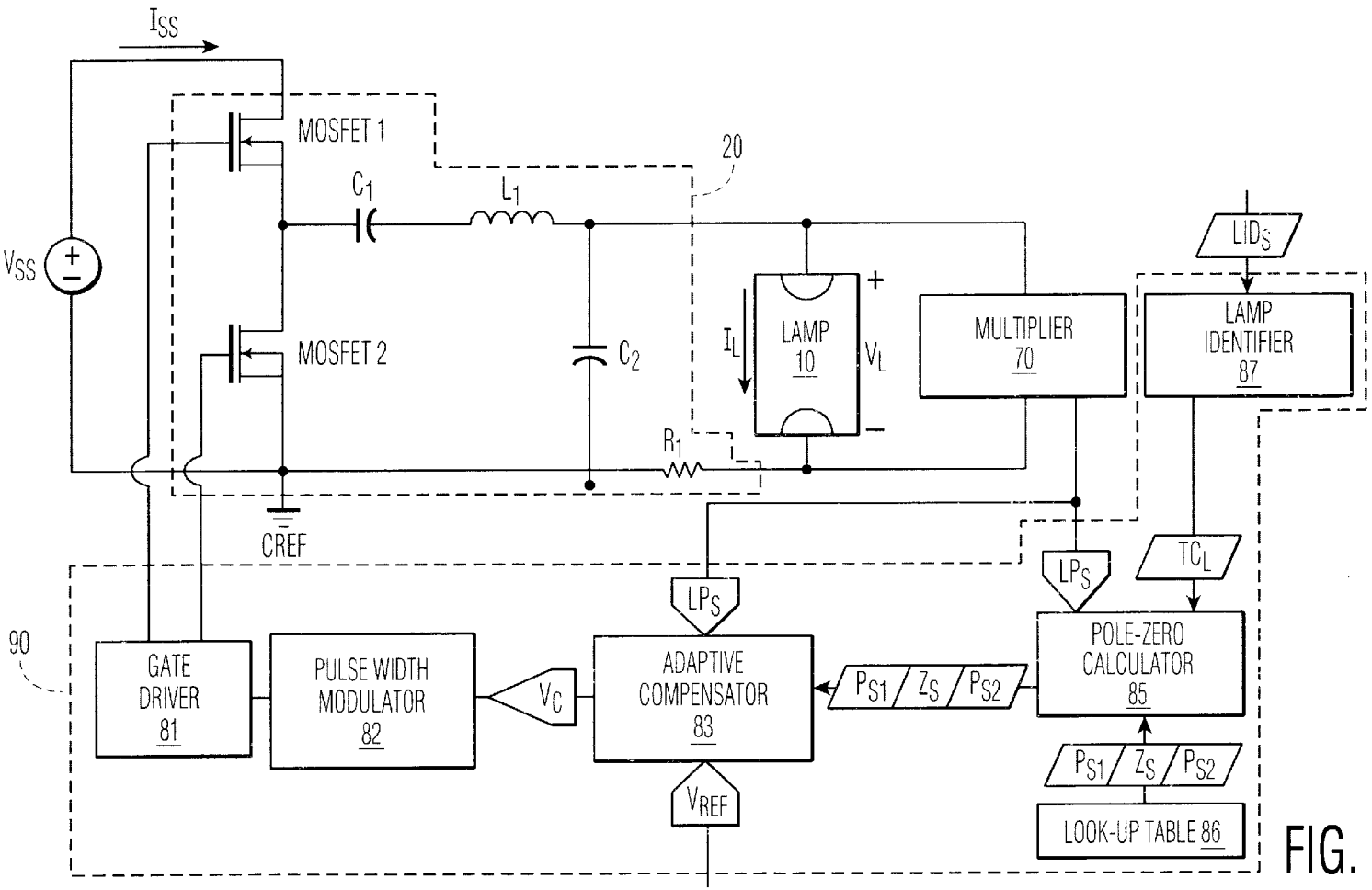
FIG. 7 illustrates a second embodiment of a universal lamp driver and an adaptive feedback compensation circuit in accordance with the present invention.

FIG. 7 illustrates universal lamp driver 20 and multiplier 70 as previously described herein in connection with FIG. 1 as well as an adaptive compensation circuit 90 in accordance with the present invention. Adaptive compensation circuit 90 comprises conventional gate driver 81, conventional pulse width modulator 82, pole-zero calculator 85, look-up table 86, and adaptive compensator 83 as previously described herein in connection with FIG. 6. Alternative to lamp identifier 84 (FIG. 6), adaptive compensation circuit 90 comprises a lamp identifier 87 that is operable to provide time constant signal $TC_S$ to pole-zero calculator 85 in response to a lamp identification signal $LID_S$ via as serial port or an RF interface from a central control unit.

In other embodiments of the present invention, an adaptive compensator based upon a current feedback control, multi-loop control, and frequency modulations can be substituted for adaptive compensator 83.

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

What is claimed is:

1. A method of adaptively controlling a lamp driver coupled to a lamp, said method comprising:

determining a steady state operation time constant corresponding to the lamp; and operating the universal lamp driver to provide a lamp current to the lamp as a function of the determined time constant of the lamp.

2. The method of claim 1, wherein the determined steady state operation time constant corresponds to the lamp voltage/current characteristics.

3. The method of claim 1, wherein the determined steady state operation time constant is a characteristic due to an ionization and recombination time delay of the lamp.

4. The method of claim 1, wherein the determined steady state operation time constant is in the range of approximately 50 μs to 500 μs.

5. A method of adaptively controlling a lamp driver coupled to a lamp, said method comprising:

identifying a lamp type of the lamp;

determining a time constant corresponding to an identification of the lamp type;

determining a zero position, a first pole position, and a second pole position in response to a determination of the time constant;

generating a control voltage as a function of the zero position, the first pole position, and the second pole position; and operating the lamp driver to stably provide a lamp current to the lamp in response to a generation of the control voltage.

6. A device, comprising:

a universal lamp driver operable to provide a lamp current to a lamp; and an adaptive compensation circuit operable to control the lamp current as a function of a time constant of the lamp during steady state operation.

7. The device of claim 6, wherein said adaptive compensation circuit includes means for determining the steady state time constant corresponding to the lamp.

8. The device of claim 6, wherein said adaptive compensation circuit includes means for determining a zero position, a first pole position, and a second pole position in response to a determination of the time constant.

9. The device of claim 6, wherein said adaptive compensation circuit includes means for generating a control voltage as a function of a zero position, a first pole position, and a second pole position corresponding to the lamp.

10. The device of claim 6, wherein the steady state operation time constant corresponds to the lamp voltage/current characteristics.

11. The device of claim 6, wherein the steady state operation time constant is a characteristic due to an ionization and recombination time delay of the lamp.

12. The device of claim 6, wherein the steady state operation time constant is in the range of approximately 50 $\mu$s to 500 $\mu$s.

13. A device, comprising:

a universal lamp driver operable to provide a lamp current to a lamp; and an adaptive compensation circuit including means for determining a time constant corresponding to a lamp type of the lamp;

means for determining a zero position, a first pole position, and a second pole position in response to a determination of the time constant;

means for generating a control voltage as a function of the zero position, the first pole position, and the second pole position; and means for operating the lamp driver to stably provide a lamp current to the lamp in response to a generation of the control voltage.

* * * * *